United States Patent [19]

O'Neill

[11] 4,049,190

[45] Sept. 20, 1977

[54] MAILING AND STORAGE BOX

[75] Inventor: James L. O'Neill, Norfolk, Mass.

[73] Assignee: Merkert Enterprises, Inc., Canton, Mass.

[21] Appl. No.: 744,953

[22] Filed: Nov. 26, 1976

[51] Int. Cl.[2] ..... B65D 5/54

[52] U.S. Cl. ..... 206/611; 229/37 R; 229/14 BW

[58] Field of Search ..... 229/14 BE, 14 BW, 14 BA, 229/51 TC, 37 R

[56] References Cited

U.S. PATENT DOCUMENTS

| | | | |
|---|---|---|---|
| 1,943,074 | 1/1934 | Heyman | 229/38 X |
| 2,359,679 | 10/1944 | Roehrl | 229/37 R |
| 2,672,273 | 3/1954 | Smith | 229/37 R |
| 3,084,844 | 4/1963 | Rattner | 229/37 R X |
| 3,099,381 | 7/1963 | Meyers | 229/37 R |
| 3,161,346 | 12/1964 | Svensson | 229/51 TC |
| 3,524,582 | 8/1970 | Buttery | 229/14 BW |
| 3,561,669 | 2/1971 | Postweiler | 229/14 BW X |
| 3,880,341 | 4/1975 | Bambarg et al. | 229/14 BE |
| 3,918,631 | 11/1975 | Hackenberg | 229/51 TC |

*Primary Examiner*—Davis T. Moorhead
*Attorney, Agent, or Firm*—Wolf, Greenfield & Sacks

[57] ABSTRACT

An end-loading, top-opening box for mailing and storing checks or the like is formed from a single blank including integral extensions which are wrapped about the box to define a surrounding protective mailing sleeve. Assembly of the integral box and wrapper requires only one straight line gluing operation by the box manufacturer and only one folding and gluing operation by the packager who receives the box and wrapper in a partly folded and glued condition from the manufacturer. The packager end loads the checks into the open ended package and then needs only to fold and glue the end flaps. No right angle or times folding or gluing operations are required. The user opens the package by tearing the single glued flap of the wrapper and then unwrapping the wrapper and tearing it along a perforated weakened line at the juncture of the wrapper and the box tray. There are no required glue connections between the box lid and tray and the box can be top-opened easily and without destroying the box.

22 Claims, 13 Drawing Figures

MAILING AND STORAGE BOX

BACKGROUND OF THE INVENTION

This invention relates to containers such as boxes, for example, of the type used to mail check blanks to bank customers and in which the box includes a top-opening lid to enable the box to be used subsequently to store cancelled checks.

The typical procedure by which a bank customer obtains check blanks is that the bank, upon notification by the customer, instructs the check printer to prepare the checks which then are sent directly from the check printer to the customer. In recent years it has become a common practice for the printer to package the check blanks and send them to the customer in a box which may be saved by the customer for later use to store his cancelled checks. The most common type of box used has been a top-loading, top-opening variety. The printer-package typically receives the box from the manufacturer in a partially glued configuration in which the lid is unglued to the tray front flap. The tray portion of the box will have been glued and folded to a flat configuration by the manufacturer. The printer then erects the box, inserts the checks and closes the lid. In order to protect the checks and the box when they are shipped to the customer, the box is usually inserted into an outer, sleeve-like, protective box which also must be folded and sealed. The check blanks thus packaged then are mailed to the customer who tears away the outer box. Sometimes, the check printer has glued the box lid to the box tray which requires the user to tear the lid flap away from the tray flap to enable the cover of the inner box to be opened.

The foregoing practice is not free from difficulty. It requires multiple operations by the box manufacturer who must die cut two blanks, one for each of the inner and outer boxes, usually from different types of sheet stock. Typically, the inner box must be partly glued and folded in an operation which requires right angle and/or timed gluing and folding techniques. Such techniques typically are much slower than straight line and untimed manufacturing techniques. Also, it may be necessary for the manufacturer to partly glue the outer box to its sleeve configuration. Multiple operations also are required by the check printer who must first partly erect the inner box, load the checks and then close (and sometimes glue) the lid. The loaded, sealed inner box then must be inserted into the outer, protective box. This requires erection of the outer box so that it can receive the inner box. The end flaps of the outer box then must be folded and glued. The foregoing practice requires a time consuming and costly right angle and/or timed gluing and/or folding operation.

Also among the difficulties sometimes encountered by the user is that the removal of the outer box is awkward. Sometimes, in order to open the outer box, the user finds it easier to tear open the end flaps. Because the inner box usually fits tightly within the outer protective box, it is difficult to withdraw the inner box through the opened end flaps of the outer box. The end flaps of the inner box, however, then are exposed and it is sometimes easier to open the inner box without removing it from the outer box by simply tearing open the end flaps of the inner box. This destroys the subsequent utility of the inner box as a top-opening box for storing checks.

It is among the primary objects of the invention to provide an improved single container blank which eliminates a number of the foregoing steps and which requires less labor and cost to package and send checks or the like in a reuseable storage box.

SUMMARY OF THE INVENTION

In brief, the invention utilizes a single blank which is foldable to define the inner box as well as an integral protective wrapper which may be detached from the box by the user in a manner which insures that the top-opening characteristic of the box will remain intact. The box includes a series of panels and flaps which define a top-opening box, this portion of the blank beginning with a tray front panel and ending with a lid front panel. A wrapper extension is integral with and extends from the box-defining panels. In one embodiment of the invention, the wrapper extension extends from the edge of the tray front panel. The wrapper extension includes four panels and an edge flap. In another embodiment of the invention, the wrapper extension extends from the lid front flap. The blank is die cut and foldscored in a single die-cutting operation. The box then is folded by the manufacturer with the wrapper portion wrapped about the box. The edge flap of the wrapper is glued to the wrapper in a simple straight-line, untimed gluing operation which is the only gluing operation required by the manufacturer. The sleeve-like pre-wrapped and pre-glued box is shipped to the check printer in a flattened configuration. The printer need only insert the checks through one of the open ends and then fold and glue the end flaps of the box which are exposed through the open ends of the wrapper. This requires only untimed, straight line gluing and/or folding. The package then is ready to be mailed to the customer. The container is opened by the user by simply tearing a pre-cut tear strip formed in the wrapper portion of the package. The protective wrapper loosely unfolds and there is no need for any further awkward manipulations of the container which might result in damage to the box and destruction of its subsequent utility for storage.

It is among the objects of the invention to provide an improved end-loading, top-opening box and protective covering in which the number of manufacturing and handling steps is reduced.

A further object of the invention is to provide a package of the type described which can be made from a single blank and which requires only the use of untimed, straight line gluing and/or folding machinery and which does not require the more expensive right angle gluing or folding techniques.

Another object of the invention is to provide a one-piece blank of the type described which includes an integral box wrapper and which includes means to separate the wrapper easily from the box and in a manner which insures that the integrity of the top-opening box will not be destroyed.

A further object of the invention is to provide a check mailing and storage box which is easier to use.

Still another object of the invention is to provide an easily openable box for the customer in which there is no need to break a glued seal in the box itself in order to obtain access to the checks.

DESCRIPTION OF DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
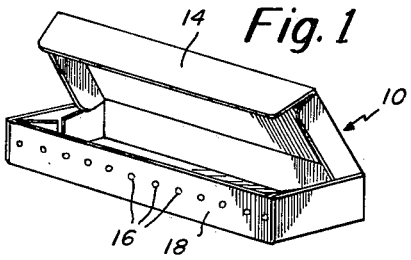
FIGS. 1 and 2 illustrate the prior art type of check mailing and storage device which include a conventional top-opening box and a protective shipping box.
Figure 2:
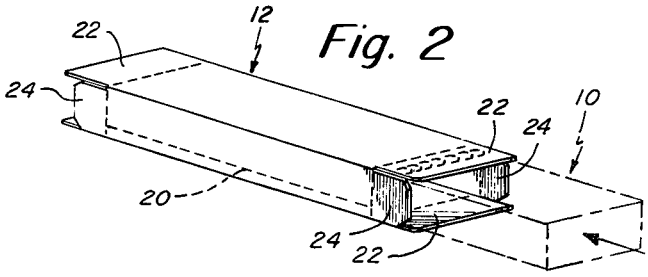
Fig. 2 PRIOR ART

FIGS. 1 and 2 show, respectively, the type of top-opening box 10 and outer protective box 12 commonly employed in the prior art. The box 10 includes various panels and flaps including a top or lid panel having a lid front flap 14. The top front flap 14 may be adhesively tacked, as suggested at 16 to the outside face of the tray front panel 18 although this is not always the case.

FIG. 2 shows the outer box 12 which receives the sealed box 10 after the checks have been end loaded. FIG. 2 illustrates a mode of assembly in which the outer box 12 is first formed to a sleeve to receive the inner box 10. The outer box 12 typically is made from a heavier, different material from the box 10 and is glued along a marginal flap 20. The outer box 12 includes the usual major and minor end flaps 22, 24 respectively. After the check printer has loaded the inner box 10 with the checks and has folded and sealed the end flaps of the inner box, the inner box 10 then is inserted into the outer box 12 as described.

Figure 3:
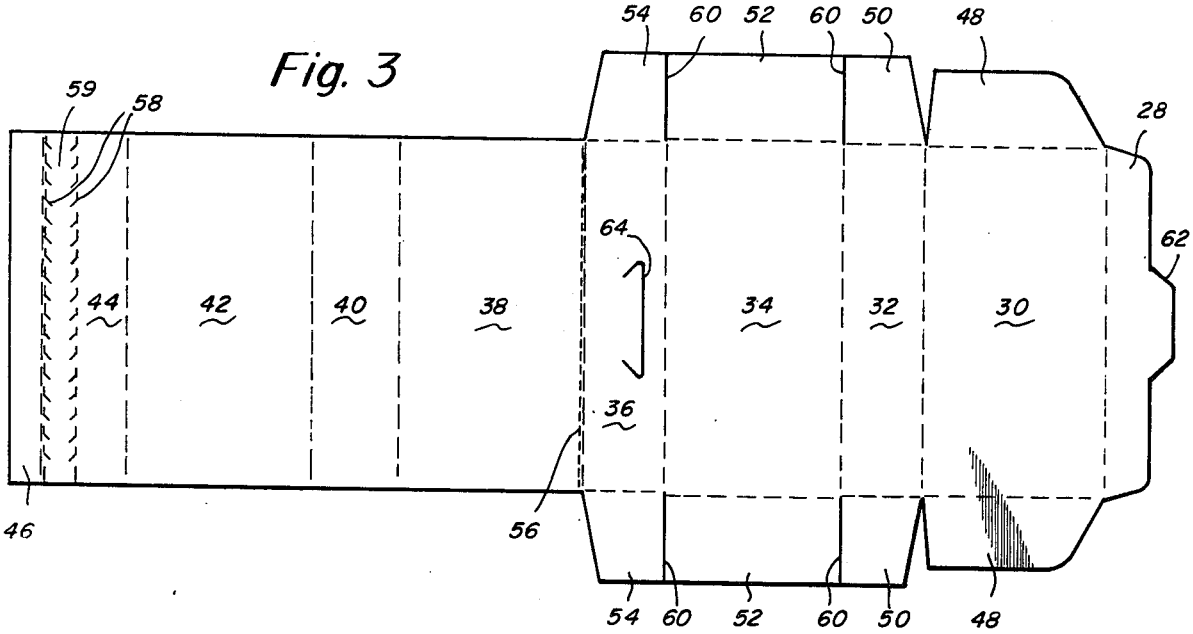
FIG. 3 is a plan view of the blank used in accordance with the invention as seen from the inside surface of the box.

FIGS. 3-7 illustrate one embodiment of the improved package in accordance with the invention. FIG. 3 shows the onepiece blank in accordance with the invention which includes, in serial connection, a lid front flap 28, a lid top panel 30, rear panel 32, tray bottom panel 34, tray front panel 36, wrapper top panel 38, wrapper rear panel 40, wrapper bottom panel 42, wrapper front panel 44 and wrapper edge flap 46. The lid top panel 30 has a pair of inner major end flaps 48. Rear panel 32 has a pair of minor end flaps 50. Tray bottom panel 34 has a pair of outer major end flaps 52 and the tray front panel 36 has a pair of minor end flaps 54. None of the wrapper panels 38, 40, 42, 44 or 46 have any associated end flaps and the wrapper panels all are of the same length, equal to the common length of the box panels 30, 32, 34 and 36. Each of the panels and their attached flaps are infolded scored to facilitate assembly of the package and to insure proper relative folding of the various panels and flaps. The fold line between tray front panel 36 and wrapper top panel 38 preferably is partially perforated as suggested at 56 to facilitate separation of the wrapper from the package when the package is opened by the user (as will be described). Wrapper front panel 44 preferably is also provided with a series of herringbone perforations, indicated at 58 to define a tear strip 59 which opens the package, as will be described. The various end flaps 48, 50, 52 and 54 are not connected to each other but, rather, are separated from each other by cut lines, indicated generally at 60. The lid front flap 28 preferably is provided with a tab 62 and the tray front panel 36 is provided with a cut slot 64 receptive to the tab 62. It should be noted that the entire blank is unitary and may be cut in a single die cutting and stamping operation to define the blank itself as well as the various slots and fold lines.

Figure 4:
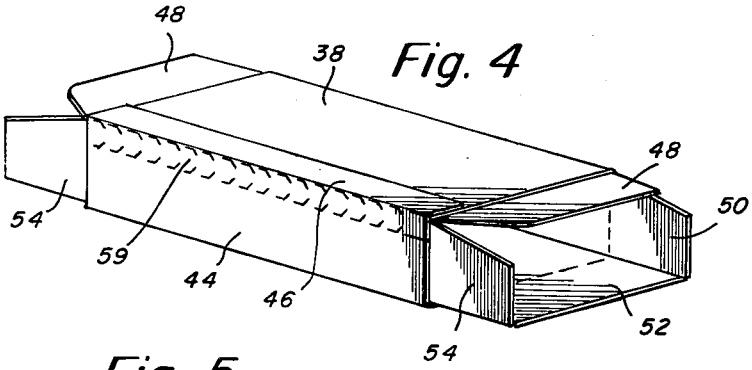
FIG. 4 is an illustration of the blank in its folded and glued configuration with its ends open.
Figure 5:
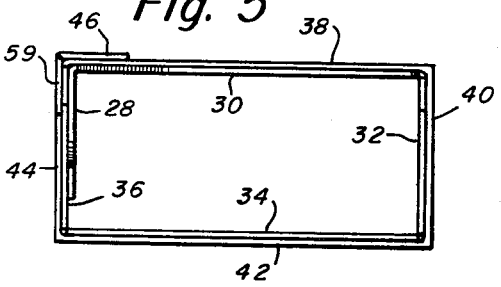
FIG. 5 is an end view similar to FIG. 4A of the package, erected to receive checks.
Figure 4A:
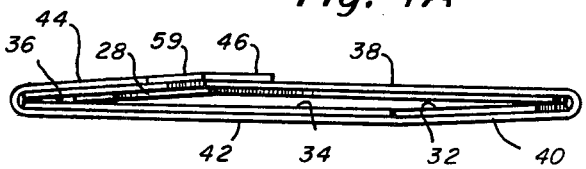
FIG. 4A is an end view of the container shown in FIG. 4 in its flattened condition as it would be when shipped to the check printer.
Figure 6:
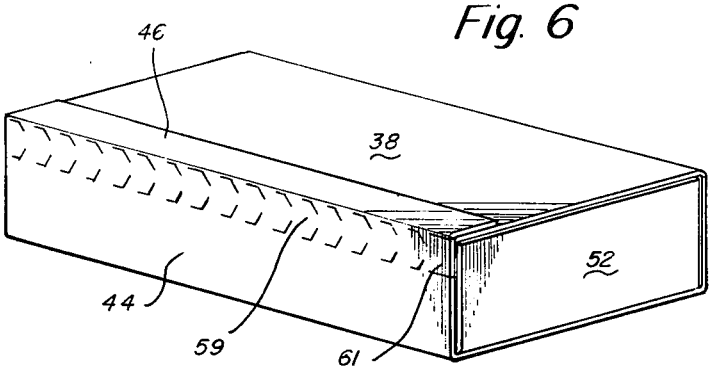
FIG. 6 is an illustration of the package ready for shipment after the printer has inserted the checks and has folded and sealed the end flaps.
Figure 7:
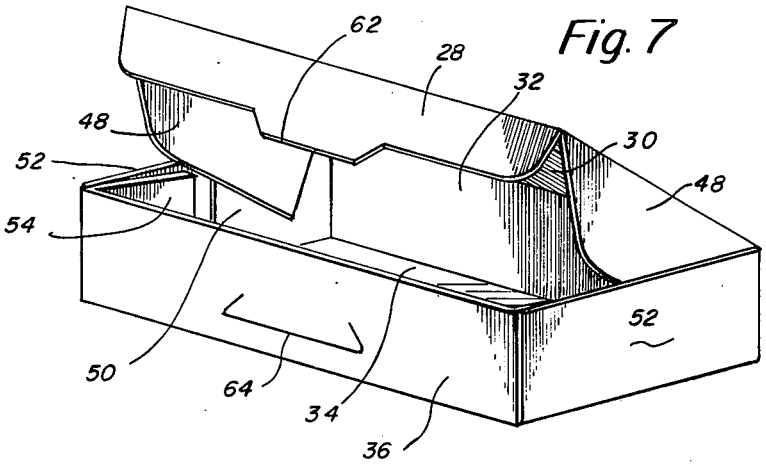
FIG. 7 is an illustration of the box after the wrapper has been removed and with the lid partly open.

FIG. 4 illustrates the box after it has been partly erected by the manufacturer and before it has been flattened to a more compact shipping configuration shown in FIG. 4A. The assembly of the box to this configuration includes the steps of folding the panels 30, 32 and 34 and the lid front flap panel 28 and tray front panel 36 to a sleeve-like configuration with the lid front flap 28 disposed interiorly of the tray front panel 36. No gluing operations are required in folding the box thus far and the lid, including the lid front flap 28 need not be adhesively attached to any portion of the tray. The wrapper extension then is wrapped about the partially assembled box with the wrapper top panel 38 overlying the lid top panel 30, wrapper rear panel 40 overlying the tray rear panel 32, wrapper bottom panel overlying the tray bottom panel 34 and wrapper front panel 44 overlying the tray front panel 36. The wrapper edge flap 46 then is wrapped over the marginal front portion of the wrapper top panel 38. A strip of adhesive is applied to the inwardly facing surface of the wrapper edge flap 46 just before it is folded down against the front margin of the wrapper top panel to adhesively secure the edge flap 46 to the wrapper top panel 38 and bind the package together in a sleeve-like configuration with the end flaps unfolded and open as suggested in FIG. 4. It should be noted that the only gluing required is of the wrapper edge flap 46 which can be accomplished very easily in a high speed untimed straight line gluing device. The open ended package then may be folded flat to the configuration suggested in FIG. 4A and shipped to the check printer-packager in that configuration.

The check printer need only unfold the package from its flattened configuration to that shown in FIG. 4 and then end load the checks through either of the open ends. The end flaps 48, 50, 52, 54 then are folded and sealed in a conventional folding and sealing device, the inner major end flaps 48 being first folded in, the minor end flaps 50 and 54 then being folded to overlie the inner major end flaps, and finally, the outer major end flaps 52 being folded and glued against the outwardly facing surfaces of the minor end flaps 50, 54. It is not essential to use a glue connection between any portion of the lid flap 28, lid 30 or the flaps 48 associated therewith. The package then is ready for shipment to the customer who receives it in the condition shown in FIG. 6. In order for the customer to open the package, he need only tear the wrapper along the herringbone tear strip 59. A starter tab 61 is provided for this purpose. The wrapper panels 38, 40 and 42 tend to unfold slightly and the top-opening feature of the box is readily apparent. The user need only detach the wrapper portion from the box portion by tearing along the weakened perforation line 56 whereupon the box is ready to be reused. There is no need for any portion of the box itself to be torn at any previously glued regions because there are none after the wrapper has been removed.

From the foregoing, it will be appreciated that the invention results in significant advantages to each of the manufacturer, check printer and user. Only one die cutting operation is required. The number of folding and gluing operations is reduced and their character simplified because of the omission of any requirement for right angle or timed gluing procedures. Also, the reuseability of the box is enhanced because there is little chance of the user improperly opening the box in a manner which would destroy its reuseability.

Figure 11:
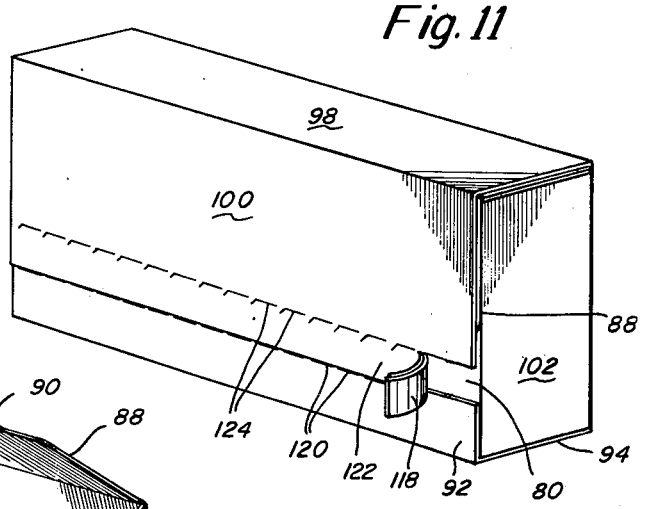
FIG. 11 is an illustration of the package as it is received by the user and illustrating the manner in which the tear strips are operated to remove the wrapper.
Figure 12:
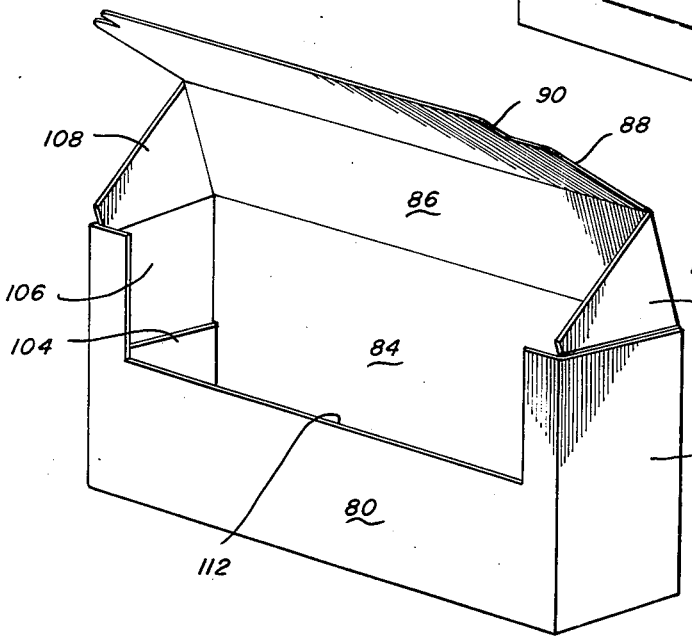
FIG. 12 is an illustration of the inner box partly open.

FIGS. 8–12 show a modified embodiment of the invention in which the box is as shown in FIG. 12, after the outer wrapper has been removed. In this embodiment of the invention, the box is narrower and more upright than in the first described embodiment and the lid includes an enlarged lid front panel as will be described. In this regard, it should be understood that in this specification and in the claims, terms such as top, bottom, front and rear are intended merely to described the relative location of the various elements of the invention with respect to each other and are not intended to be used in an absolute sense.

Figure 8:
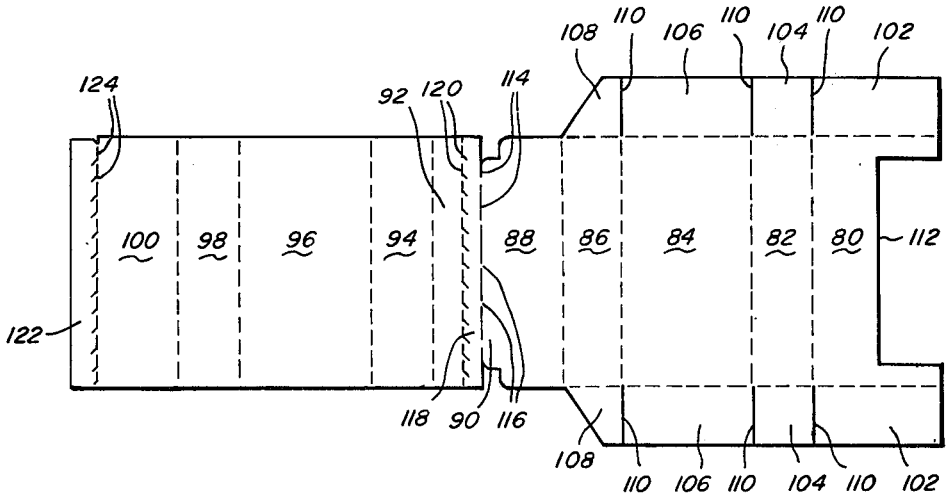
FIG. 8 is a plan view of the blank of a modified embodiment of the invention as seen from the inside surface of the box.

As shown in FIG. 8, the blank includes, in serial connection, a lower tray front panel 80, a tray bottom panel 82, a tray rear panel 84, a lid top panel 86 and a lid front flap 88 which has a tab 90 extending therefrom. The blank also includes a wrapper segment which continues, serially, from the end of the tab 90 to define a lower front wrapper panel 92, a bottom wrapper panel 94, a rear wrapper panel 96, a top wrapper panel 98 and an upper front wrapper panel 100. The panels 80–86 which define the inner box configuration includes flaps extending from their ends, thus, outer major end flaps 102 extending from the lower front tray panel 80, minor end flaps 104 extending from the bottom tray panel 82, inner major flaps 106 extending from the rear tray panel 84 and minor end flaps 108 extending from the lid panel 86. Each of the adjacent flaps 102, 104, 106 and 108 are separated and defined by cuts in the blank, indicated at 110. Minor flaps 108 are diagonally cut so that their outermost ends are tapered as shown. The tray front panel 80 has an enlarged U-shaped cutout portion 112 which will be covered by the lid front flap 88 and engages the tab 90.

The wrapper portion of the blank is attached to the tab 90 along a relatively weak tear line which is defined by a plurality of elongate cuts 114. The wrapper portion is attached by a plurality of small connective portions 116 between the cuts 114.

The lower front wrapper panel 92 is provided with a tear strip 118 which is defined by a plurality of spaced slits 120. The upper front wrapper panel 100 also includes, at its outermost edge, a tear strip 122 which is defined by a line of similar slits 124. The wrapper configuration is such that when the wrapper is wrapped fully about the box segments, the outer tear strip 122 will overlie and register with the inner tear strip 118 so that they may both be stripped simultaneously thus removing the wrapper in a single operation.

Figure 9:
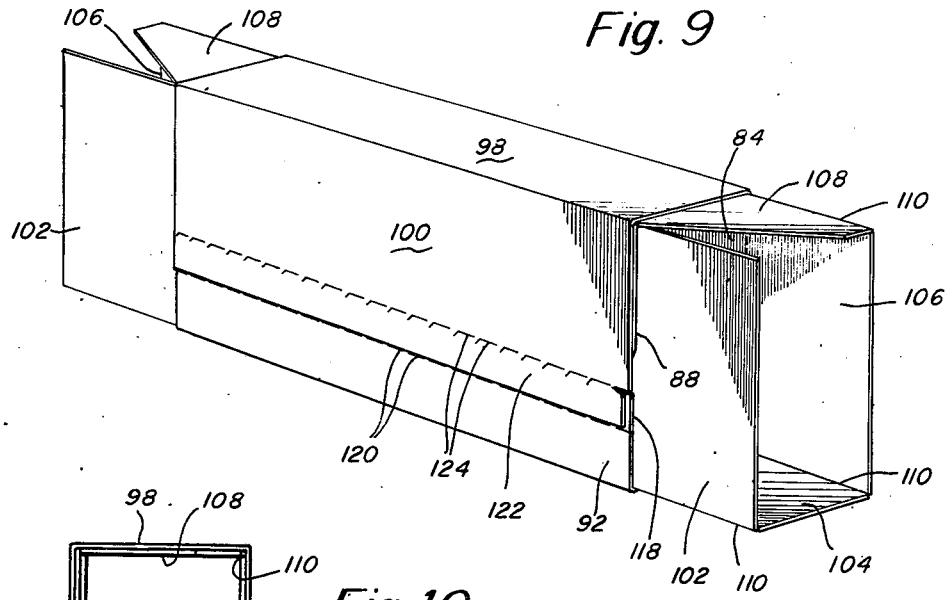
FIG. 9 is an illustration of the blank shown in FIG. 8 in its folded and glued configuration with its ends open.
Figure 10:
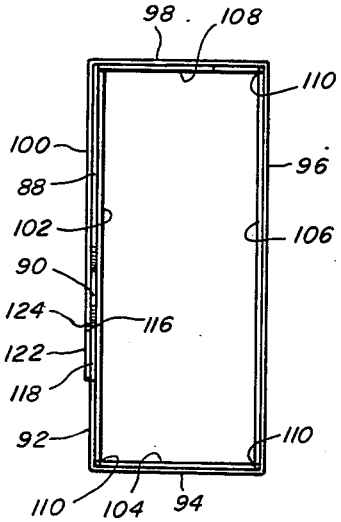
FIG. 10 is an end view of the package shown in FIG. 9 ready to receive the blank checks.

FIG. 9 illustrates the box in its partly assembled configuration with its end flaps open to enable it to be end-loaded. When the package is assembled to this intermediate configuration, the lower front wrapper panel 92 overlies the lower region of the tray front panel 80, the wrapper bottom panel 94 underlies the tray bottom panel 82, wrapper panel 96 overlies the tray rear panel 84, wrapper top panel 98 overlies the top lid panel 86 and top front panel 100 overlies the front lid flap 88 including its tab 90. The tear strip 122 overlies and is adhesively attached to the tear strip 118. The package configuration shown in FIG. 9 can be folded to a flat configuration for shipping. It can then be reerected to the end loadable configurations shown in FIGS. 9 and 10 in readiness to be filled. After the container has been loaded, the flaps are folded and glued, with the minor flaps 104, 108 being first folded in, then the inner major flaps 102 and then the outer major flaps 106. The flaps 102, 104 and 106 are adhesively attached to each other with flap 102 being sandwiched between the other two flaps. The package then is ready for shipment to the bank customer.

FIG. 11 illustrates the manner in which the box is opened by the user. The registered tear strips are stripped away in a single motion which completely separates the wrapper segment from the inner box segment. Thereafter, the box may be used as suggested in FIG. 12. The box may be closed by inserting the tab 90 into the box when the lid is in its closed configuration.

In this embodiment, it will also be appreciated that there is only one die cutting operation required and that the number of folding and gluing operations is reduced as well as their character simplified because of the omission of any requirement for right angle or timed gluing procedures. Moreover, the reuseability is enhanced because no portion of the box itself may be inadvertently torn when the package is opened.

It should be understood that the foregoing description of the invention is intended merely to be illustrative of the invention and that other embodiments and modifications may be apparent to those skilled in the art without departing from its spirit. For example, although the invention has been described as being of particular utility to package and ship checks, the advantages of the invention may be used to package and ship other types of articles.

Having thus described the invention, what I desire to claim and secure by Letters Patent is:

1. A blank for a container comprising:

a tray portion including a series of serially connected flaps and panels including, in sequence a lid front flap, a lid panel, a rear panel, a tray panel and a tray front flap, each of said panels having end flaps extending therefrom at opposite ends thereof, said flaps and panels being foldable to define an end-loadable, top-opening box configuration;

said blank further including a wrapper extension extending from and defining a continuation of the tray portion, said wrapper extension including, serially, a wrapper top panel, a wrapper rear panel, a wrapper bottom panel and a wrapper front panel;

at least one of said wrapper panels having a tear-strip formed therein; and the juncture between the tray portion and wrapper extension being weakened to facilitate tearing of the wrapper extension from the tray portion.

2. A container formed from the blank defined in claim 1.

3. A blank as defined in claim 1 further comprising: said tear strip being located and extending along the wrapper front panel of the wrapper extension.

4. A container formed from the blank defined in claim 3.

5. A blank as defined in claim 1 further comprising: said wrapper extension being connected to and extending from the tray front flap.

6. A container formed from the blank defined in claim 5.

7. A blank as defined in claim 5 further comprising: said wrapper front panel having a wrapper edge flap attached thereto.

8. A container formed from the blank defined in claim 7.

9. A blank as defined in claim 1 further comprising: said wrapper extension being connected to and extending from the lid front flap.

10. A container formed from the blank defined in claim 9.

11. A blank for a container comprising:

a tray portion including a series of serially connected flaps and panels including, in sequence, a lower tray front panel, a bottom tray panel, a rear tray panel, a lid panel and a lid front flap, each of said panels having end flaps extending therefrom at opposite ends thereof, said flaps and panels being foldable to define an end-loadable, top-opening box configuration;

said blank further including a wrapper extension extending from and defining a continuation of the lid front flap, said wrapper extension including, serially, a lower front wrapper panel, a bottom wrapper panel, a rear wrapper panel, a top wrapper panel and an upper front wrapper panel, the upper front wrapper panel including, at its outer end, a marginal tear strip which will overlie a portion of the lower front wrapper panel when the container is assembled;

the lower front wrapper panel having a tear strip formed therein at a location which is registerable with the marginal tear strip portion of the upper front wrapper panel when the blank is assembled. and the juncture between the lid front panel and the bottom wrapper panel being weakened to facilitate tearing therealong.

12. A blank as defined in claim 11 wherein the juncture between the tray portion and the wrapper extension defines a portion of the tear strip formed in the lower front wrapper panel.

13. A blank as defined in claim 11 further comprising:

the tray front panel having a U-shaped cutout formed therein;

the outermost edge of the lid front panel being cutaway at its ends to define a tab, receptive in the U-shaped cutout portion of the tray front panel when the wrapper extension is removed.

14. A container formed from the blank defined in claim 13.

15. A package assembly comprising:

an inner box portion including a series of serially connected flaps and panels including, in sequence, a lid front flap, a lid panel, a rear panel, a tray panel and a tray front flap, each of said panels having end flaps extending therefrom at opposite ends thereof to define an open-ended configuration;

a wrapper extension extending from and defining a continuation of the inner box portion, said wrapper extension including, serially, a wrapper top panel overlying the lid panel of the inner box, a wrapper rear panel overlying the rear panel of the inner box, a wrapper bottom panel overlying the tray panel of the inner box, a wrapper front panel overlying the tray front flap of the inner box, the outer marginal edge of the wrapper extension overlying another portion of the wrapper extension and being adhesively attached to the wrapper top panel;

at least one of said wrapper panels having a tear strip formed therein; and the juncture between the box portion and the wrapper extension being weakened to facilitate tearing of the wrapper extension from the inner box.

16. A container as defined in claim 15 further comprising:

said end flaps being folded and glued to close the ends of the container in a manner in which the outer major flaps of the tray panel are glued to the minor flaps of the rear panel and tray front flap of the inner box and in which the end flaps of the lid panel lie within but are not attached to the minor flaps.

17. A container as defined in claim 16 wherein there is no glue connection between any portion of the lid, lid front flap or lid end flaps with any other portion of the box.

18. A box as defined in claim 17 further comprising:

the lid front flap having a tab extension protruding therefrom and the tray front flap having a slot formed therein receptive to the tab extension.

19. A blank as defined in claim 1 which is formable into a box and surrounding wrapper without using right angle gluing procedures.

20. A blank as defined in claim 1 which is formable into a box and surrounding wrapper without using right angle folding procedures.

21. A blank as defined in claim 1 which is formable into a box and surrounding wrapper without using timed gluing procedures.

22. A blank as defined in claim 1 which is formable into a box and surrounding wrapper without using timed folding procedures.

* * * * *